US010632483B1

(12) United States Patent
Gillaspy et al.

(10) Patent No.: US 10,632,483 B1
(45) Date of Patent: Apr. 28, 2020

(54) UNIVERSAL PRESSURIZED SPRAY ADAPTER

(71) Applicants: Nathan Gillaspy, Edmond, OK (US); Ben Truong, Edmond, OK (US); Preston Stout, Edmond, OK (US)

(72) Inventors: Nathan Gillaspy, Edmond, OK (US); Ben Truong, Edmond, OK (US); Preston Stout, Edmond, OK (US)

( * ) Notice: Subject to any disclaimer, the term of this patent is extended or adjusted under 35 U.S.C. 154(b) by 0 days.

(21) Appl. No.: 15/998,024

(22) Filed: Jun. 13, 2018

(51) Int. Cl.
*B05B 9/08* (2006.01)

(52) U.S. Cl.
CPC ..... *B05B 9/0822* (2013.01)

(58) Field of Classification Search
CPC ..... B05B 1/12; B05B 11/3063; B05B 9/0816; B05B 9/043; B05B 9/0822; A01M 7/0046; A47L 11/4088; B65D 83/14
USPC ..... 222/402.1
See application file for complete search history.

(56) References Cited

U.S. PATENT DOCUMENTS 4,154,401 A * 5/1979 Thompson ..... B05B 9/0833 222/402
4,606,477 A * 8/1986 Spengler ..... A47L 11/1625 222/153.09
4,787,560 A * 11/1988 DeYoreo ..... A01G 25/145 222/174
5,186,391 A * 2/1993 Roueche ..... B05B 9/0816 222/400.8
5,335,855 A 8/1994 Borod
5,823,372 A 10/1998 Levine
5,868,286 A 2/1999 Mascetelli
6,021,924 A 2/2000 Suck
6,409,103 B1 6/2002 Norville
9,744,545 B2 * 8/2017 Rhea ..... B05B 9/0827
2012/0091092 A1 4/2012 Adams

* cited by examiner

*Primary Examiner* — Paul R Durand
*Assistant Examiner* — Robert K Nichols, II
(74) *Attorney, Agent, or Firm* — Randal Homburg

(57) ABSTRACT

A universal pressurized spray nozzle replaces a standard trigger spray nozzle on a bottle having liquid content, the universal pressurized spray bottle providing a pneumatic pump to pressurize the contents of the bottle wherein the trigger release on the pressurized spray bottle releases a steady stream of liquid under pressure from the bottle, with the spray nozzle providing an assortment of different length nozzle tubes which are adapted to bottles of various depths and interchangeable bottle caps which are provided for bottles having various diameter bottle openings and thread patterns.

3 Claims, 7 Drawing Sheets

UNIVERSAL PRESSURIZED SPRAY ADAPTER

I. BACKGROUND OF THE INVENTION

1. Field of Invention

A universal pressurized spray nozzle replaces a standard trigger spray nozzle on a bottle having liquid content, the universal pressurized spray bottle providing a pneumatic pump to pressurize the contents of the bottle wherein the trigger release on the pressurized spray bottle releases a steady stream of liquid under pressure from the bottle, with the spray nozzle providing an assortment of different length nozzle tubes which are adapted to bottles of various depths and interchangeable bottle caps which are provided for bottles having various diameter bottle openings and thread patterns.

2. Description of Prior Art

A preliminary review of prior art patents was conducted by the applicant which reveal prior art patents in a similar field or having similar use. However, the prior art inventions do not disclose the same or similar elements as the present universal pressurized spray nozzle, nor do they present the material components in a manner contemplated or anticipated in the prior art.

Several prior art patents include nozzles that dispense contents, replacing the release mechanics of the bottle nozzle with one that is modified. For example, U.S. Patent Application No. 2012/0091092 to Adams discloses an endoscope that adapts to a water bottle. Two pump nozzle replacement for bottles are disclosed in U.S. Pat. No. 6,021,924 to Suck and U.S. Pat. No. 5,868,286 to Mascitelli. A directional nozzle is demonstrated in U.S. Pat. No. 6,409,103 to Norville, which provides for adjustment of spray in a 360 degree rotation.

Two devices were shown to provide pressure to the contents of a bottle for release, one appearing to be adapted to specific bottles which accompanies the devices and the second applied to a bottle where the cap is removed to keep the contents under pressure, as in a soda bottle. In U.S. Pat. No. 5,335,855 to Borod, the hygienic spray bottle is used for a douche and bidet while the user conducts personal hygiene functions. It provides a multi-directional spray discharge tube for obtaining various angles of spray and a plurality of liquid spray holes for release of multiple streams of flow. The other is the soda bottle adaptive lid which engages the open bottle and provides a pump means to pressurize the contents as the bottle is closed with the modified cap, disclosed as U.S. Pat. No. 5,823,372 to Levine.

II. SUMMARY OF THE INVENTION

Using most liquid spray bottles that are sold to disperse the contents requires the pull on a trigger to spray the contents, with each pull of the trigger eliminating a "squirt" of the contents. When spraying a large area, several pulls are required. Large areas may include kitchen counters for cleaning products, mold and scale elimination from showers and bathtubs, toilet bowl cleaners, paint removal products, stain eliminating products, car care products, spot weed sprays, insect treatments and other products which are sold in non-aerosol dispensers. Generally, if some method of pressurized application is preferred, transfer of the liquid into a pump sprayer container is required, which can be an issue if the entire contents are not used, requiring reintroduction in to the product container. The repeated spray action may become tiring, especially for those with physical restrictions or who simply become tired easily who lack stamina.

The present universal pressurized spray adapter replaces the factory supplied spray device on the factory supplied bottle, is universally applied having a variety of interchangeable internal bottle spray tubes of different lengths suited for variable depths of the various bottle containers, a variety of interchangeable caps on the sprayer adapted to bottles with different neck sizes and thread patterns, and a common pressurizing pump apparatus to pressurize the inside of the bottle to which the universal sprayer is attached, providing the bottle with a singular pull pressurized spray means to eliminate the bottle contents as desired and for a long as the user desires.

III. DESCRIPTION OF THE DRAWINGS

The following drawings are submitted with this utility patent application.

Figure 6:
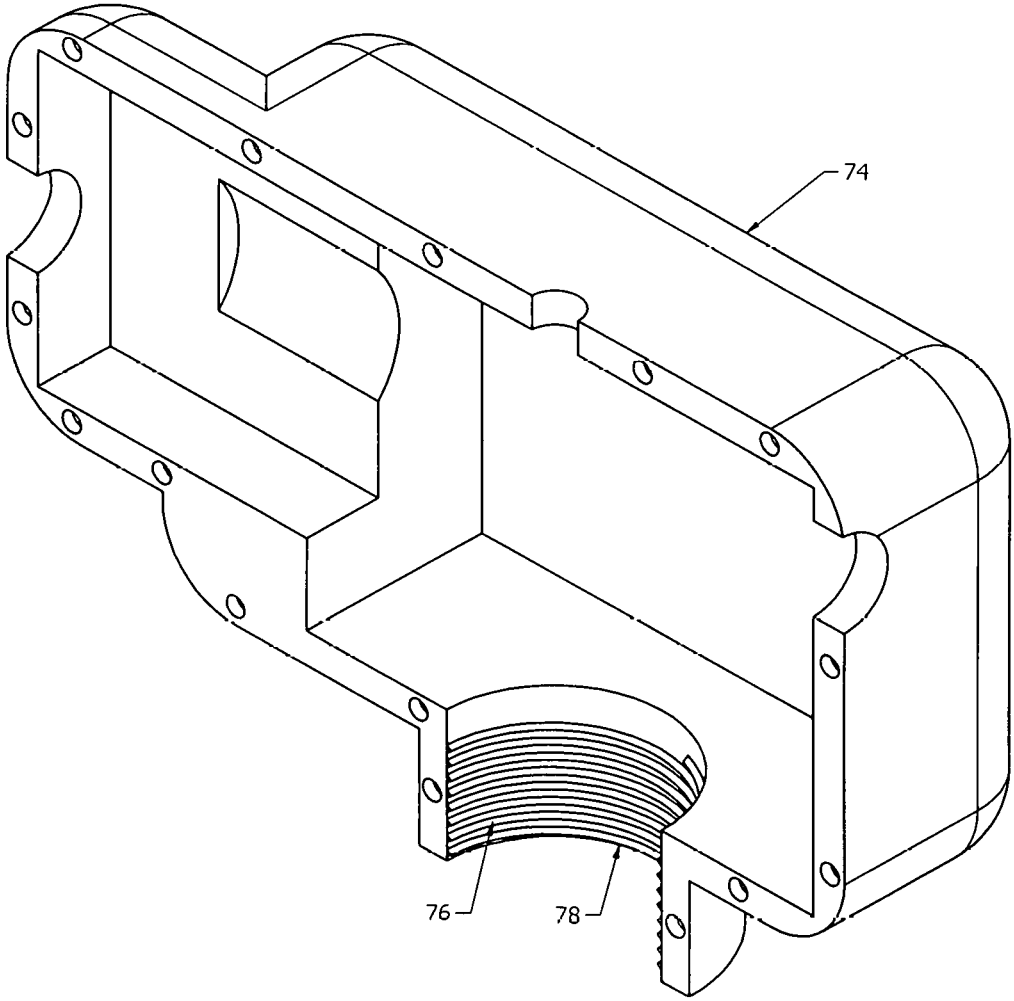

FIG. 6 as an inside perspective view of the right section encasement.

Figure 7:
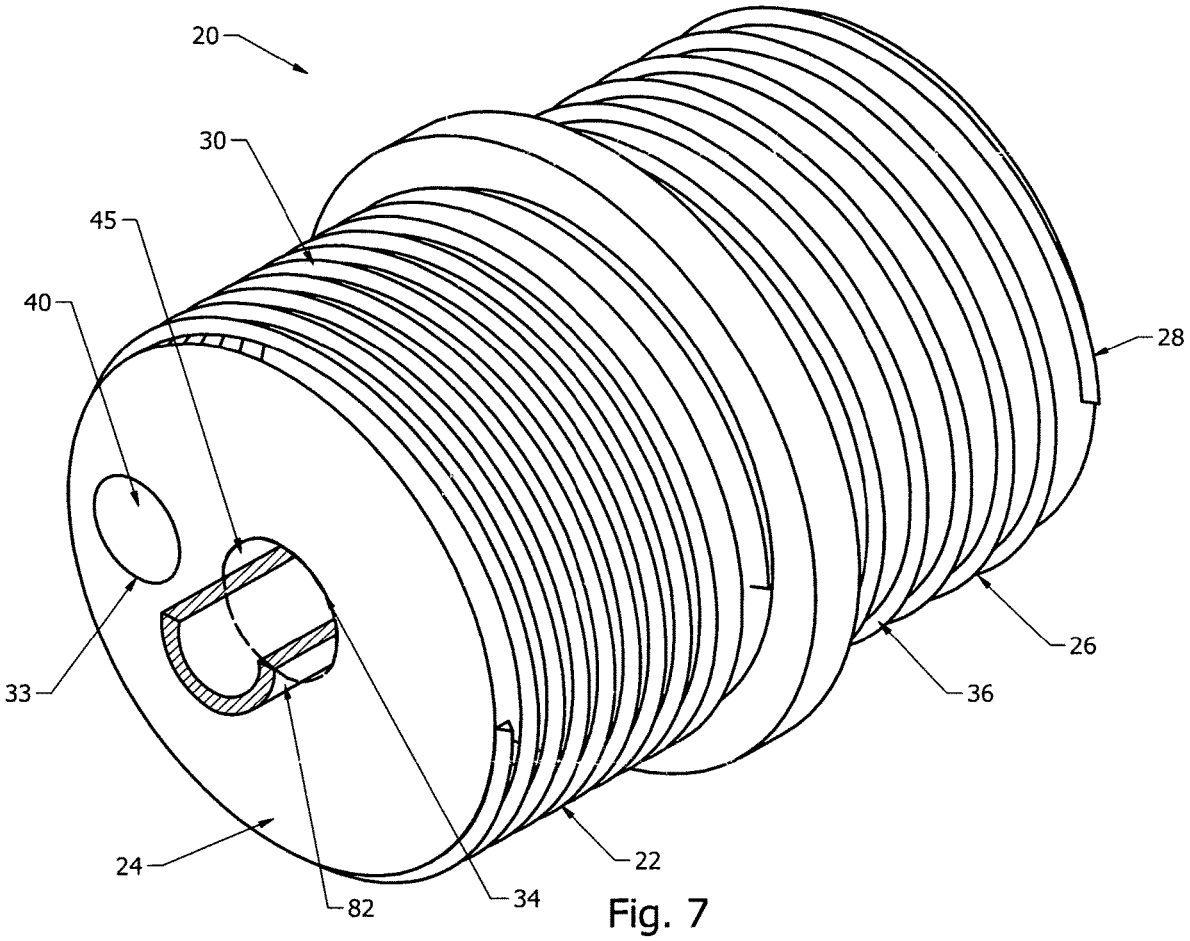

FIG. 7 is a lower perspective view of the dual threaded adapter indicating the lower draw stem port and the lower pressure tube outlet port.

IV. DESCRIPTION OF THE PREFERRED EMBODIMENT

A universal pressurized spray adapter 10 for a liquid bottle, shown in FIGS. 1-7, replaces a factory pump trigger spray nozzle to provide for pressurization of the bottle and its liquid contents for release of a pressurized flow of the liquid contained in the bottle.

Figure 1:
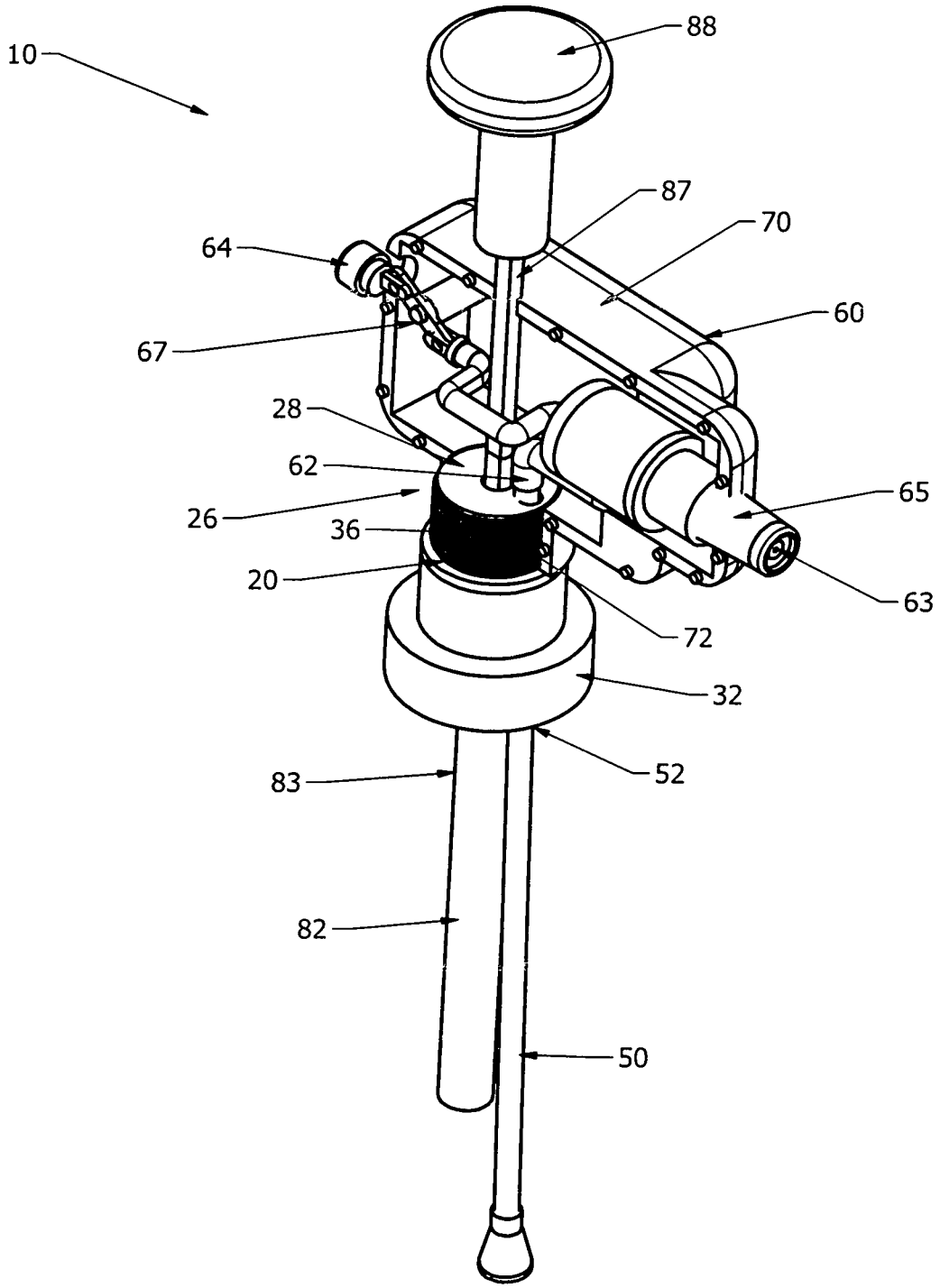
FIG. 1 is a perspective side view of the pressurized spray adapter with the right section encasement removed to expose the spray nozzle assembly of the pressurized spray adapter.

The spray adapter 10 comprises a dual threaded transition member 20, FIG. 7, having a lower end 22 defining outer threads 30 which are applied to a selected bottle cap adapter 32 to an outer threaded neck of a bottle, with the bottle cap adapter 32 provided in various inner diameters to adapt to bottle neck of a variety of sized bottles. The lower end 22, FIG. 7 further comprises a lower surface 24 defining a lower draw stem port 33 and a lower pressure tube outlet port 34, each port defining the entry of a respective draw stem channel 40 and a pressure tube channel 45. The draw stem channel 40 secures an upper end 52 of a hollow draw stem 50, FIG. 1, which is provided in a variety of lengths, with the appropriate selected draw stem 50 dependant upon the depth of the bottle to which the spray adapter 10 is applied. The pressure tube channel 45 receives an outer perimeter surface 83 of a hollow outer plunger tube 82 of a plunger tube assembly 80, FIGS. 1 and 5, which forms an airtight seal between the lower pressure tube outlet port 34, FIG. 7, and the outer perimeter surface 83 of the outer plunger tube 82. The dual threaded transition member further comprises an upper end 26 defining outer threads 36 and an upper surface 28 defining a spray nozzle outlet port 37, which integrates with the draw stem channel 40 and a plunger assembly inlet port 38 integrating with the pressure tube channel 45. The plunger tube assembly 80, as shown in FIG. 1, therefore penetrates through the pressure tube channel 45 and further seals the plunger tube assembly 80 within the plunger assembly inlet port 38.

Figure 2:
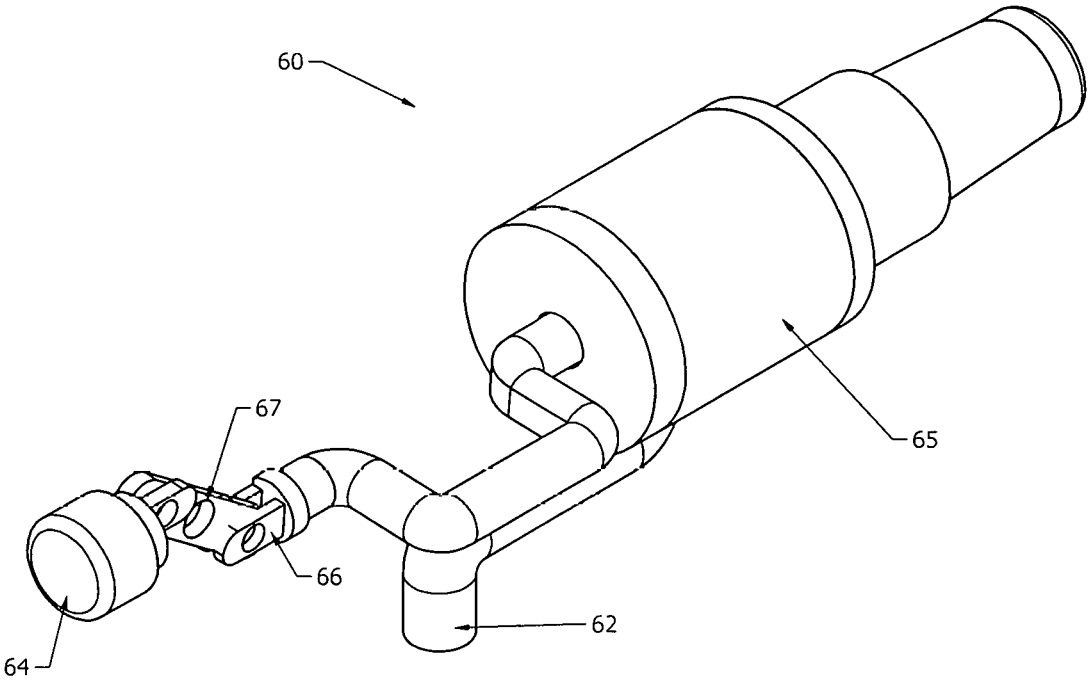
FIG. 2 is a perspective view of the spray nozzle assembly.
Figure 3:
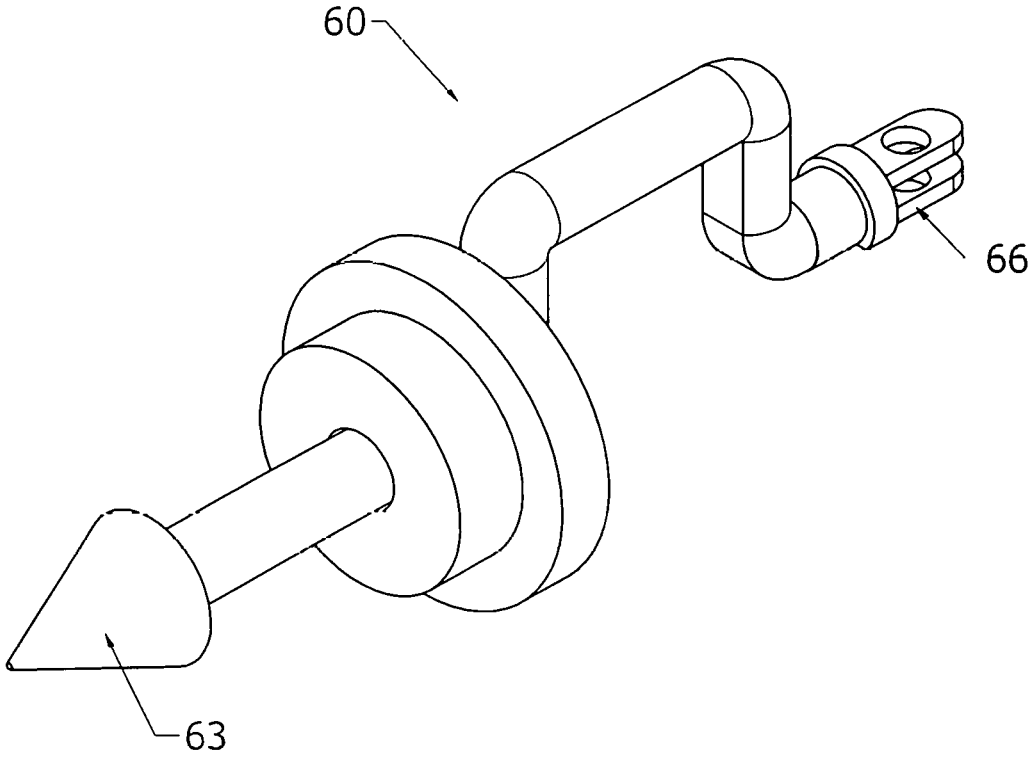
FIG. 3 is a perspective view of the spray nozzle tubing and nozzle plunger.

The spray adapter 10 further comprises a spray nozzle assembly 60 further defining a spray nozzle uptake tube 62 which engages and secures within the spray nozzle outlet port 37 and connects through the draw stem channel 40 with the draw stem 50 to supply liquid content of the bottle to the spray nozzle assembly 60 under pressure created by the pressurization of the bottle contents by the involvement of the plunger tube assembly 80. The spray nozzle uptake tube 62 transfers the pressurized liquid content into the spray nozzle release tip 63 upon activation by pressing the pressure release button 64, which opens the nozzle release tip 63 to allow the liquid content to exit an adjustable spray nozzle housing 65 under pressure. The spray nozzle housing 65 is engaged over the spray nozzle tip 63, with the spray nozzle tip 63 moving forward and backward within the spray nozzle housing 65 between an open and closed position. The pressure release button 64 is connected to the nozzle release tip 63 by a pivotal release lever 66 which withdraws a release lever arm 67, the pivotal release lever 66 and release lever arm 67 attaching between the pressure release button 64 and the nozzle release tip 63, as shown in FIGS. 2-3. The entire spray nozzle assembly 60 is encased between a left section encasement 70, FIG. 1, and right section encasement 74, FIG. 6. The pivotal release lever 66 is pivotally mounted within the left section encasement 70, which may be reversed to be contained within the right section encasement 74, wherein the pressure release button 64 is depressed, the pivotal release lever 66 pivotally withdraws the release lever arm 67, extending the spray nozzle release tip 63 and releasing the liquid through the hollow draw stem 50 into the uptake tube 62 through the nozzle housing 65 directed at an intended target where the liquid content is to be disbursed. The upper end 26 of the dual threaded transition member 20 receives opposing mated inner threads 72, 76, of the left section member 70 and right section member 74 joined together to enclose the spray nozzle assembly 60, with the facing inner threads 72, 76, of the left section member 70 and right section member 74 forming an inner threaded cylinder 78 which engage the outer threads 36 of the upper end 26 of the dual threaded transition member 20, securing the spray nozzle assembly 60 to the dual threaded transition member 20, the dual threaded transition member 20 further secured to the bottle by the appropriate selected bottle cap adapter 32, extending the appropriate selected draw stem 50 into the bottle and the liquid contents contained within the bottle.

Figure 4:
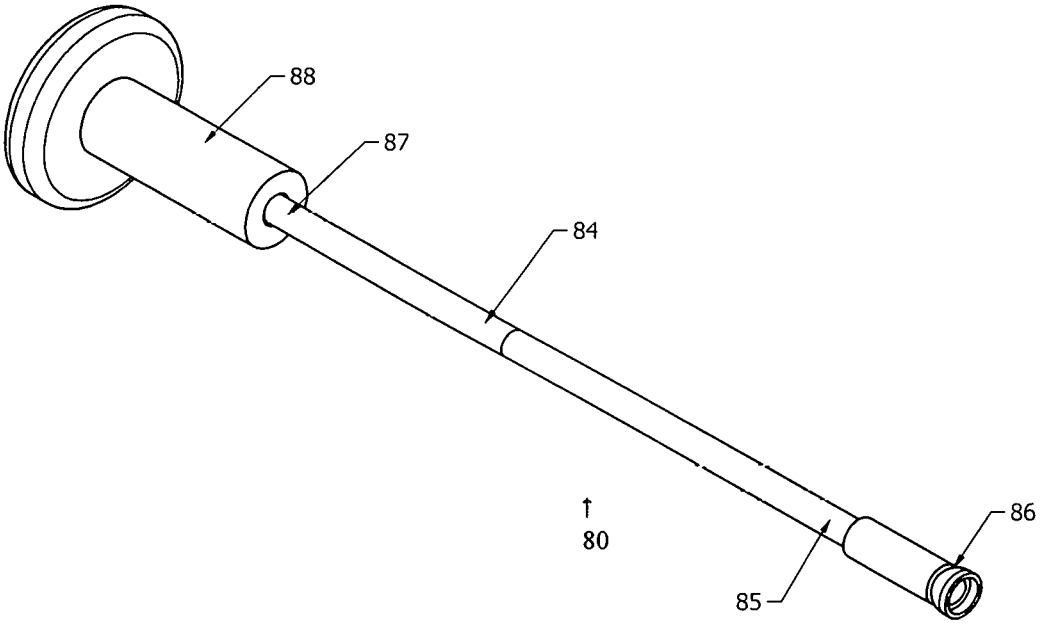
FIG. 4 is a perspective view of the pressure plunger.
Figure 5:
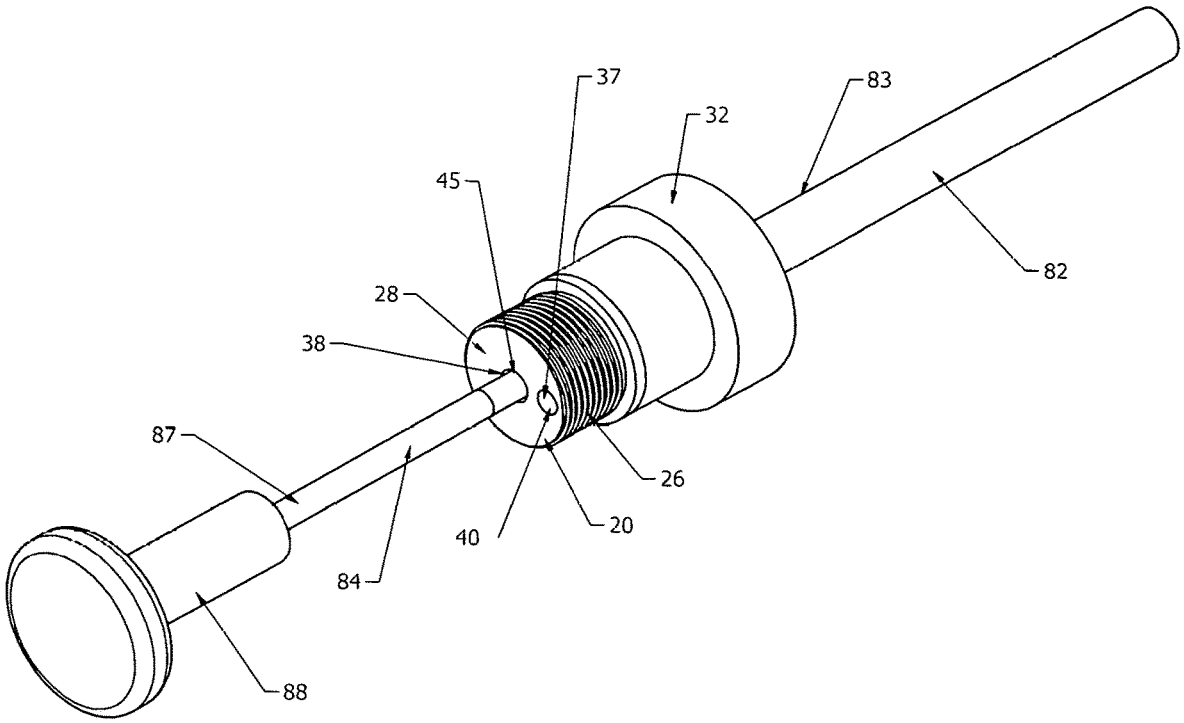
FIG. 5 is a perspective view of the plunger assembly attached to the universal bottle top adapter.

Once the spray adapter 10 is secured upon the bottle, the plunger tube assembly 80, FIGS. 4-5, is utilized to pressurize the bottle. The plunger tube assembly 80 further comprises the hollow outer plunger tube 82, which engages the pressure tube channel 45 through the dual threaded transition member 20, with a lower end 85 of a plunger rod 84 inserted within the hollow outer plunger tube 82 with a plunger expansion 86 terminating at the lower end 85 of the plunger rod 84, the plunger expansion 86 forming an air tight seal between the plunger expansion 86 and the hollow outer plunger tube 82, drawing air from outside the spray adapter 10 and forcing it into the bottle each time the plunger rod 84 is raised and lowered, in a pumping motion. The plunger expansion 86 prevents an outflow of the air into the bottle, but causes the inflow of air into the bottle, thereby creating the pressure required to operate the spray adapter 10. The plunger rod 84 further defines an upper end 87 with an upper plunger knob 88, FIGS. 1 and 4-5, to lift and press the plunger rod 84 to pressurize the bottle contents.

Optionally, the spray nozzle housing 65 may provide and adjustable spray pattern, not shown, but contemplated within the scope of the invention. In addition, the spray nozzle assembly 60 may use some means other than the pressure release button 64, which may be supplied as a lever, a trigger, or other means which can be pressed, pulled or otherwise manipulated to activate the movement of the spray nozzle release tip 63.

While the universal pressurized spray adapter 10 has been particularly shown and described with reference to a preferred embodiment thereof, it will be understood by those skilled in the art that changes in form and detail may be made therein without departing from the spirit and scope of the invention.

What is claimed is:

1. A universal pressurized spray adapter configured to be applied to a liquid bottle and replace a factory pump trigger spray nozzle for pressurization of the liquid bottle and liquid contents therein, and for release of a pressurized flow of the liquid contents contained in the bottle, said universal pressurized spray adapter comprising: a dual threaded transition member including a lower end having outer threads and a lower surface, an upper end having outer threads and an upper surface, said lower end including a bottle cap adapter configured to be applied to an outer threaded neck of said liquid bottle, said lower surface defining a lower draw stem port and a lower pressure tube outlet port, and said upper surface defining a spray nozzle outlet port and a plunger assembly inlet port;

a draw stem channel formed within said dual threaded transition member between said spray nozzle outlet port and said lower draw stem port, and a pressure tube channel also formed within said dual threaded transition member between said plunger assembly inlet port and said lower pressure tube outlet port;

a hollow draw stem including an upper end sealably engaged within said lower draw stem port in communication through said draw stem channel with an uptake tube of the spray nozzle assembly, the uptake tube sealably attached within said spray nozzle outlet port;

a plunger tube assembly defining a hollow outer plunger tube defining an outer surface extending through said pressure tube channel beyond said lower pressure tube outlet port into said liquid bottle, said plunger tube assembly further comprising a plunger rod within said hollow outer plunger tube, said plunger rod defining a lower end with a plunger expansion which produces a pressure within said liquid bottle when raised and lowered within said hollow outer plunger tube, wherein the liquid contents within said liquid bottle are pressurized and upon activation of said spray nozzle assembly, said liquid contents are expelled from said spray nozzle assembly through a spray nozzle release tip, being drawn through said hollow draw stem when a release button is depressed within said spray nozzle assembly directing said liquid contents within said liquid bottle out said spray nozzle assembly under pressure.

2. The universal spray nozzle adapter of claim 1, wherein the uptake tube is engaged and secured within said spray nozzle outlet port connecting through said draw stem channel with said draw stem in communication with said liquid contents within said liquid bottle under pressure;

said release button attaching to a release lever by a pivotal lever arm which opens said spray nozzle assembly to divert said liquid contents to a nozzle housing and further into said spray nozzle release tip; and a left section encasement attaching to a right section encasement containing said spray nozzle assembly, said left and right section encasement joined together, with said right section encasement defining inner threads and said left section encasement defining inner threads, said inner threads forming an inner threaded cylinder engaging and securing said upper end of said transition member forming a seal, and said left and right section encasement providing support for said spray nozzle assembly including a pivotal capacity of said lever arm within said spray nozzle assembly, wherein said release button is moved to activate said spray nozzle tip to allow for a pressurized flow of liquid contents from within said liquid bottle directing said liquid contents out of said spray nozzle under pressure.

3. The universal spray nozzle adapter of claim 1, said plunger tube assembly further comprising:

said hollow outer plunger tube sealably engaging said pressure tube channel through said dual threaded transition member, with said lower end of said plunger rod inserted within said hollow outer plunger tube with said plunger expansion terminating at said lower end of said plunger rod, said plunger expansion forming an air tight seal between said plunger expansion and said hollow outer plunger tube, drawing air from outside said spray adapter and forcing said air into said liquid bottle each time said plunger rod is raised and lowered in a pumping motion, said plunger expansion preventing release of said air from said liquid bottle, thereby creating the pressure required to operate said spray adapter, said plunger rod further defining an upper end with an upper plunger knob to lift and depress said plunger rod to pressurize the said liquid bottle and liquid contents.

* * * * *